US008002918B2

(12) United States Patent
Ohji

(10) Patent No.: US 8,002,918 B2
(45) Date of Patent: Aug. 23, 2011

(54) GAS GENERATING COMPOSITION

(75) Inventor: Nobuyuki Ohji, Hyogo (JP)

(73) Assignee: Daicel Chemical Industries, Ltd., Osaka (JP)

( * ) Notice: Subject to any disclaimer, the term of this patent is extended or adjusted under 35 U.S.C. 154(b) by 1004 days.

(21) Appl. No.: 11/892,644

(22) Filed: Aug. 24, 2007

(65) Prior Publication Data

US 2008/0053581 A1 Mar. 6, 2008

(30) Foreign Application Priority Data

Aug. 29, 2006 (JP) ..... 2006-231520

(51) Int. Cl.
*D03D 23/00* (2006.01)

(52) U.S. Cl. ..... 149/109.4

(58) Field of Classification Search ..... 149/109.4, 149/19.1

See application file for complete search history.

(56) References Cited

U.S. PATENT DOCUMENTS

| | | | | |
|---|---|---|---|---|
| 5,114,898 | A * | 5/1992 | Pinnavaia et al. | 502/406 |
| 6,033,500 | A | 3/2000 | Ito et al. | |
| 6,416,599 | B1 | 7/2002 | Yoshikawa et al. | |
| 2003/0051630 | A1 * | 3/2003 | Katsuda et al. | 102/531 |

FOREIGN PATENT DOCUMENTS

| | | | |
|---|---|---|---|
| EP | 0864553 | A1 | 9/1998 |
| EP | 1061057 | A1 | 12/2000 |
| EP | 1205457 | A1 | 5/2002 |
| JP | 05-000879 | A | 1/1993 |
| JP | 11-310490 | A | 11/1999 |
| JP | 2000-319086 | A | 11/2000 |
| JP | 2001-192288 | A | 7/2001 |
| WO | WO-97/05087 | A | 2/1997 |
| WO | WO-97/20786 | A1 | 6/1997 |
| WO | WO-98/29361 | A1 | 7/1998 |

* cited by examiner

*Primary Examiner* — Aileen Felton
(74) *Attorney, Agent, or Firm* — Birch, Stewart, Kolasch & Birch, LLP

(57) ABSTRACT

The present invention relates to a gas generating composition including a fuel, an oxidizing agent, a binder and an additive, the additive being one or two or more selected from complex basic carbonates represented by Formula (I) or (II) below;

$$M_1^{+}M_2^{3+}CO_3(OH)_2 \quad (I)$$

$$M_3^{2+}M_4^{2+}CO_3(OH)_2 \quad (II)$$

(In Formula (I), $M_1^{+}$ stands for $H^+$, $Li^+$, $Na^+$, $K^+$, or $NH^{4+}$; $M_2^{3+}$ stands for $Al^{3+}$, $Fe^{3+}$, $Cr^{3+}$, $Co^{3+}$, $In^{3+}$, $Bi^{3+}$, $Sb^{3+}$, $B^{3+}$, $Sc^{3+}$, or $Ga^{3+}$;
in Formula (II), $M_3^{2+}$ and $M_4^{2+}$ are mutually different, each standing for $Cu^{2+}$, $Zn^{2+}$, $Co^{2+}$, $Ni^{2+}$, $Mg^{2+}$, $Mn^{2+}$, $Fe^{2+}$, or $Be^{2+}$).

4 Claims, No Drawings

GAS GENERATING COMPOSITION

This nonprovisional application claims priority under 35 U. S. C. §119(a) on Patent Application No. 2006-231520 filed in Japan on 29 Aug. 2006 which is incorporated by reference.

BACKGROUND OF INVENTION

1. Field of Invention

The present invention relates to a gas generating composition that can be used in airbag inflators or the like.

2. Description of Related Art

Gas generating agents for airbag inflators generally include a fuel, an oxidizing agent, a binder, and various additives. From the standpoint of ensuring safety of the occupants, it is preferred that the amount of gas hazardous to a human body in the gas generated by combustion of the gas-generating agent be reduced to a minimum.

A method of shifting the oxygen balance of a gas-generating agent to a (+) side with respect to a stoichiometric ratio and a method of introducing a metal hydroxide such as aluminum hydroxide as an additive are known as conventional methods for decreasing CO concentration in the gas.

When a method of adjusting the oxygen balance of the gas generating agent is employed, the amount of generated CO can be reduced, but the problem is that the amount of generated nitrogen oxides (NOx) is increased. When a method of introducing a metal hydroxide is employed, the amount of generated CO can be reduced, but the ignition ability of the gas generating agent tends to decrease.

JP-A No. 05-879, WO-A No. 97/05087, JP-A No. 11-310490, WO-A No. 97/20786, JP-A No. 2000-319086, WO-A No. 98/29361 and JP-A No. 2001-192288 may be cited as related arts of the present invention.

SUMMARY OF INVENTION

The present invention relates to a gas generating composition including a fuel, an oxidizing agent, a binder and an additive, the additive being one or two or more selected from complex basic carbonates represented by Formula (I) or (II) below;

$$M_1^{+}M_2^{3+}CO_3(OH)_2 \quad (I)$$

$$M_3^{2+}M_4^{2+}CO_3(OH)_2 \quad (II)$$

(In Formula (I), $M_1^{+}$ stands for $H^{+}$, $Li^{+}$, $Na^{+}$, $K^{+}$, or $NH^{4+}$; $M_2^{3+}$ stands for $Al^{3+}$, $Fe^{3+}$, $Cr^{3+}$, $Co^{3+}$, $In^{3+}$, $Bi^{3+}$, $Sb^{3+}$, $B^{3+}$, $Sc^{3+}$, or $Ga^{3+}$;

in Formula (II), $M_3^{2+}$ and $M_4^{2+}$ are mutually different, each standing for $Cu^{2+}$, $Zn^{2+}$, $Co^{2+}$, $Ni^{2+}$, $Mg^{2+}$, $Mn^{2+}$, $Fe^{2+}$, or $Be^{2+}$).

DETAILED DESCRIPTION OF INVENTION

Hydrotalcite-type compounds described in JP-A No. 05-879 and WO-A No. 98/29361 are called layered complex hydroxides and have a layered structure in which a plurality of hydroxides are in a stacked state. Divalent and trivalent metal cations are introduced between the layers, and therefore the structure as a whole is charged positively. For this reason, anions are additionally introduced between the layers to maintain electrostatic balance, and it is essential that molecules of water (interlayer water) be present between the anions. The problem arising when such a compound having water molecules is used as a starting material for a gas generating composition is that mass loss occurs in a temperature-resistant environment and heat resistance decreases due to generated moisture.

The structure of the complex basic carbonate used in the present invention (a combination of monovalent and trivalent or divalent and divalent metal cations) does not have a layered structure as the above-described hydrotalcite-type compound. Therefore, the presence of water molecules (interlayer water) is not required and the risk of raising the above-described problem is low.

The present invention relates to a gas generating composition that can reduce the amount of generated CO, without decreasing the ignition ability, and does not increase the generation of other gases hazardous to a human body.

The present invention relates to:

the gas generating composition wherein the binder is an organic material-based binder and/or an inorganic material-based binder (called as an organic binder and/or an inorganic binder);

a preferable gas generating composition wherein the binder is one or two or more selected from carboxymethyl cellulose, carboxymethyl cellulose sodium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, microcrystalline cellulose, polyacrylamide, amination product of polyacrylamide, polyacryl hydrazide, a copolymer of acrylamide and a metal acrylate, a copolymer of polyacrylamide and polyacrylic ester, polyvinyl alcohol, acrylic rubber, gua gum, starch, and silicone; or a preferable gas generating composition wherein the binder is one or two or more selected from aluminum oxide sol, silicon oxide sol, titanium oxide sol, and antimony oxide sol.

The gas-generating agent in accordance with the present invention can reduce the generation of CO, without increasing the generation of gases hazardous to a human body, such as NOx. Further, the gas generating agent in accordance with the present invention does not decrease the ignition ability as in the case where aluminum hydroxide is contained as an additive.

EMBODIMENTS OF INVENTION

Fuels that have been used in the conventional gas generating agents can be used as the fuel for the present invention, but those of them that are nitrogen-containing organic compounds are preferred. Examples of suitable nitrogen-containing organic compounds include one or two or more selected from guanidine nitrate, nitroguanidine, 5-aminotetrazole, ammonium nitrate, and melamine.

Oxidizing agents that have been used in the conventional gas generating agents can be used as the oxidizing agent for the present invention, but among them basic copper nitrate, basic copper carbonate, potassium nitrate, sodium nitrate, strontium nitrate, potassium perchlorate, sodium perchlorate, and ammonium perchlorate are preferred.

The binder for use in the present invention can be an organic binder or an inorganic binder. Binders of both kinds can be also used together.

The organic binder is one or two or more selected from carboxymethyl cellulose, carboxymethyl cellulose sodium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, microcrystalline cellulose, polyacrylamide, amination product of polyacrylamide, polyacryl hydrazide, a copolymer of acrylamide and a metal acrylate, a copolymer of polyacrylamide and polyacrylic ester, polyvinyl alcohol, acrylic rubber, gua gum, starch, and silicone. Among them, one or two or more selected from carboxymethyl cellulose, polyvinyl alcohol, gua gum, and starch are preferable.

The inorganic binders are preferably sols of inorganic substances. The sols of inorganic substances may contain water or an organic solvent as a dispersion medium. It is preferred that a sol of inorganic substance be used as a binder because the generated amount of gases (NOx or ammonia) toxic to a human body can be reduced. Further, sols of inorganic substances cause no reduction in moldability that is a problem encountered when known inorganic binders are used.

A metal oxide sol is preferred as a sol of an inorganic substance, and one or two or more selected from aluminum oxide sol, silicon oxide sol, titanium oxide sol, and ammonium oxide sol can be used as the metal oxide sol.

The additive for use in the present invention is one or two or more selected from complex basic carbonates represented by Formulas (I) or (II) below.

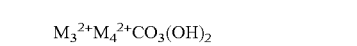

$$M_1^{+}M_2^{3+}CO_3(OH)_2 \quad (I)$$

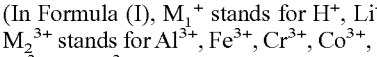

$$M_3^{2+}M_4^{2+}CO_3(OH)_2 \quad (II)$$

(In Formula (I), $M_1^{+}$ stands for $H^+$, $Li^+$, $Na^+$, $K^+$, or $NH^{4+}$; $M_2^{3+}$ stands for $Al^{3+}$, $Fe^{3+}$, $Cr^{3+}$, $Co^{3+}$, $In^{3+}$, $Bi^{3+}$, $Sb^{3+}$, $B^{3+}$, $Sc^{3+}$, or $Ga^{3+}$;

in Formula (II), $M_3^{2+}$ and $M_4^{2+}$ are mutually different, each standing for $Cu^{2+}$, $Zn^{2+}$, $Co^{2+}$, $Ni^{2+}$, $Mg^{2+}$, $Mn^{2+}$, $Fe^{2+}$, or $Be^{2+}$).

In the complex basic carbonates represented by Formula (I), $M_1^{+}$ is preferably $Na^+$, $K^+$, $NH^{4+}$, and $M_2^{3+}$ is preferably $Al^{3+}$, $Fe^{3+}$, $Co^{3+}$.

In the complex basic carbonates represented by Formula (II), $M_3^{2+}$ and $M_4^{2+}$ are preferably $Cu^{2+}$, $Zn^{2+}$, $Mg^{2+}$ ($M_3^{2+}$ and $M_4^{2+}$ differ from each other).

The content ratios of the fuel, oxidizing agent, binder, and additive (complex basic carbonate) in the gas generating composition in accordance with the present invention are presented below. When a metal oxide sol is used as a binder, the ratio is presented based on the mass of solid components excluding the dispersion medium.

The fuel is contained preferably at 10 to 70 mass %, more preferably 20 to 60 mass %, even more preferably 30 to 50 mass %.

The oxidizing agent is contained preferably at 25 to 85 mass %, more preferably 30 to 70 mass %, even more preferably 40 to 60 mass %.

The organic binder is contained preferably at 0.1 to 20 mass %, more preferably 1 to 15 mass %, even more preferably 3 to 10 mass %.

The inorganic binder (metal oxide sol) is contained preferably at 0.1 to 20 mass %, more preferably 1 to 15 mass %, even more preferably 3 to 10 mass %.

The additive (complex basic carbonate) is contained preferably at 0.1 to 20 mass %, more preferably 1 to 15 mass %, even more preferably 3 to 10 mass %. Where the aforementioned components are contained in the above-described ranges, generation of CO can be inhibited and generation of hazardous gases such as NOx can be also inhibited.

In addition to the above-described components, the gas-generating agent in accordance with the present invention can include, within ranges in which the effect of the present invention is not degraded, various additives that have been generally contained in known gas-generating agents. Such additive is one or two or more selected from metal oxides such as copper oxide, iron oxide, zinc oxide, cobalt oxide, manganese oxide, molybdenum oxide, nickel oxide, bismuth oxide, silica, and alumina; cobalt carbonate, calcium carbonate; complex compounds of metal oxides or hydroxides such as Japanese acid clay, kaolin, talc, bentonite, diatomaceous earth, and hydrotalcite; sodium silicate, mica molybdate, cobalt molybdate, metal oxide salt such as molybdate ammonium molybdenum disulfide, calcium stearate, silicon nitride, and silicon carbide.

The content of the additive (excluding complex basic carbonates represented by Formulas (I) or (II)) is appropriately selected according to the type of the additive, but is preferably about 0.1 to 20 parts by mass based on a total of 100 parts by mass of the fuel, oxidizing agent, binder, and complex basic carbonates represented by Formulas (I) or (II).

The gas generating composition in accordance with the present invention can be molded to a desired shape and can be in the form of a single-perforated column, a porous column, or a pellet. In the cases of a single-perforated column and a porous column, the holes may pass through the column in the longitudinal direction, or may be formed as recesses rather than through holes.

A method of mixing the fuel, the oxidizing agent, the binder and the additive (complex basic carbonate) in a kneader to obtain a mixture and then extrusion-molding the mixture with an extruder can be employed as a method for manufacturing the gas generating composition in accordance with the present invention. When a gel of an inorganic substance including water or an organic solvent as a dispersion medium is used as the binder, water or organic solvent may be added, if necessary, during mixing in a kneader.

The gas generating composition in accordance with the present invention can be applied to an airbag inflator for a driver side, an airbag inflator for a passenger side, an airbag inflator for a side collision, an inflatable curtain inflator, a knee bolster inflator, an inflatable seat belt inflator, a tubular system inflator, and a gas generator for a pretensioner of various vehicles.

Further, the inflator using the gas generating composition in accordance with the present invention may be of a pyrotechnic type in which the gas is generated only from a gas generating composition, or of a hybrid type that uses a compressed gas such as argon and a gas generating composition.

Further, the gas generating composition in accordance with the present invention can be also used as an ignition agent called enhancer agent (or booster) for transmitting energy of a detonator or a squib to the gas generating composition.

EXAMPLES

Examples and Comparative Examples (1) Preparation of a Test Strand

The gas-generating compositions (mixtures prior to molding) of Examples and Comparative Examples were dried for 16 hours at 110° C., ground and then classified twice through a SUS sieve having a mesh size of 300 μm to adjust a particle size. A total of 2.00 g of each mixture having the adjusted particle size was loaded to a mortar side of a predetermined die, compressed and held for 5 seconds under a pressure of 14.7 MPa applied with a hydraulic pump from a rod end surface, removed and molded to obtain test samples in the form of columnar strands having an outer diameter of 9.55 mm.

(2) Method for Measuring Gas Concentration

A columnar strand of the test sample was placed into a sealed SUS cylinder having an internal capacity of 1 liter and nitrogen was supplied under pressure into the cylinder to obtain a pressure of 7 Mpa and replace the entire atmosphere inside the cylinder with a constant pressure. A predetermined current was then passed to a nichrome wire that was brought into contact with the end surface of the strand, and the strand was ignited and combusted by the current energy. After 60 seconds, once the gas has been uniformly distributed inside the cylinder, an open plug portion of a predetermined Tedlar bag equipped with a plug was connected to a gas discharge portion of the cylinder, the combustion gas inside the cylinder was sampled by transferring into the bag, and the concentrations of $NO_2$, NO, $NH_3$, and CO were measured with gas detection tubes (No. 10 for $NO_2$ and NO detection; No. 3L for $NH_3$ detection; and No. 1L for CO detection) manufactured by Gastec Corporation Gas concentrations in Examples 1, 2 were represented by relative values obtained by taking the gas concentrations of Comparative Example 1 for 100%. The results are shown in Table 1.

TABLE 1

| | | Ex. 1 | Ex. 2 | Ex. 3 | Comparative Ex. 1 |
|---|---|---|---|---|---|
| Fuel | Guanidine nitrate | 36.3 | 39.4 | 40.4 | 40.7 |
| Oxidizing agent | Basic copper nitrate | 51.2 | 48.1 | 47.1 | 49.3 |
| Binder | Carboxymethyl cellulose | 5.0 | 5.0 | 5.0 | 5.0 |
| Additive | $NH_4AlCO_3(OH)_2$ | 7.5 | — | — | — |
| | $NaAlCO_3(OH)_2$ | — | 7.5 | — | — |
| | $Al(OH)_3$ | — | — | — | 5.0 |
| | $ZnCuCO_3(OH)_2$ | — | — | 7.5 | — |
| Gas concentration (ppm) | $NO_2$ | 100.0% | 100.0% | 100.0% | 100.0% |
| | NO | 109.1% | 118.2% | 109.1% | 100.0% |
| | $NH_3$ | 83.3% | 100.0% | 100.0% | 100.0% |
| | CO | 38.2% | 55.9% | 52.9% | 100.0% |

Content of all components is represented in mass %

As shown in Table 1, the generation of NO in Examples 1, 2 slightly increased over that in Comparative Example 1, but the generation of CO was significantly suppressed. Further, observations performed during gas concentration measurements confirmed that ignition ability in Examples 1, 2, 3 was equal to or better than that of Comparative Example 1, despite the fact that the compositions of Examples 1 to 3 include a larger amount of additives than the composition of the Comparative Example 1.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A gas generating composition comprising a fuel, an oxidizing agent, a binder, and an additive, the additive being one or two or more selected from the group consisting of complex basic carbonates represented by Formula (I) or (II) below:

$$M_1^{+}M_2^{3+}CO_3(OH)_2 \quad (I)$$

in which $M_1^{+}$ stands for $H^+$, $Li^+$, $Na^+$, $K^+$, or $NH^{4+}$; $M_2^{3+}$ stands for $Al^{3+}$, $Fe^{3+}$, $Cr^{3+}$, $CO^{3+}$, $In^{3+}$, $Bi^{3+}$, $Sb^{3+}$, $B^{3+}$, $Sc^{3+}$, or $Ga^{3+}$;

$$M_3^{2+}M_4^{2+}CO_3(OH)_2 \quad (II)$$

in which $M_3^{2+}$ and $M_4^{2+}$ are mutually different, each standing for $Cu^{2+}$, $Zn^{2+}$, $Co^{2+}$, $Ni^{2+}$, $Mg^{2+}$, $Mn^{2+}$, $Fe^{2+}$, or $Be^{2+}$, wherein said gas generating composition does not have a layered structure.

2. The gas generating composition according to claim 1, wherein the binder is an organic material-based binder and/or an inorganic material-based binder.

3. The gas generating composition according to claim 1 or 2, wherein the binder is one or two or more selected from the group consisting of carboxymethyl cellulose, carboxymethyl cellulose sodium salt, carboxymethyl cellulose potassium salt, carboxymethyl cellulose ammonium salt, cellulose acetate, cellulose acetate butyrate, methyl cellulose, ethyl cellulose, hydroxyethyl cellulose, ethylhydroxyethyl cellulose, hydroxypropyl cellulose, carboxymethylethyl cellulose, microcrystalline cellulose, polyacrylamide, amination product of polyacrylamide, polyacryl hydrazide, a copolymer of acrylamide and a metal acrylate, a copolymer of polyacrylamide and polyacrylic ester, polyvinyl alcohol, acrylic rubber, guar gum, starch, and silicone.

4. The gas generating composition according to claim 1 or 2, wherein the binder is one or two or more selected from the group consisting of aluminum oxide sol, silicon oxide sol, titanium oxide sol and antimony oxide sol.

* * * * *